15
5
B
A
9a
1
29
4
9
35
32
2
31
30
6
29
5
9a
5

United States Patent [19]

Greeson

[11] 3,941,267

[45] Mar. 2, 1976

[54] MOBIL LOAD RAISING STRUCTURE

[75] Inventor: Logan C. Greeson, Madison, Ga.

[73] Assignee: Hi Bridger, Inc., Madison, Ga.

[22] Filed: June 6, 1974

[21] Appl. No.: 477,105

[52] U.S. Cl. ..... 214/730; 214/16.4 A

[51] Int. Cl.[2] ..... B66F 9/14

[58] Field of Search 214/730, 731, 16.4 A, 16.1 CB; 187/9, 95, 27

[56] References Cited

UNITED STATES PATENTS

| | | | |
|---|---|---|---|
| 3,101,130 | 8/1963 | Bianca | 187/27 |
| 3,175,722 | 3/1965 | Paulssen | 214/16.4 A |
| 3,301,413 | 1/1967 | Coursey | 214/16:1 CB |
| 3,329,240 | 7/1967 | Harwood et al. | 187/95 |
| 3,596,789 | 8/1971 | Aaronson et al. | 214/730 |
| 3,757,899 | 9/1973 | Smith, Jr. | 214/730 |
| 3,786,929 | 1/1974 | Hathcock, Jr. | 214/16.4 A |
| 3,792,758 | 2/1974 | Wentz | 214/730 |

*Primary Examiner*—Robert J. Spar
*Assistant Examiner*—Lawrence J. Oresky
*Attorney, Agent, or Firm*—Ulle C. Linton

[57] ABSTRACT

A mobile structure for movement alongside the frames of buildings under construction, capable of raising heavy and also long loads vertically and then laterally onto a floor of said building frame as well as moving loads from the building frame and lowering the same.

3 Claims, 12 Drawing Figures

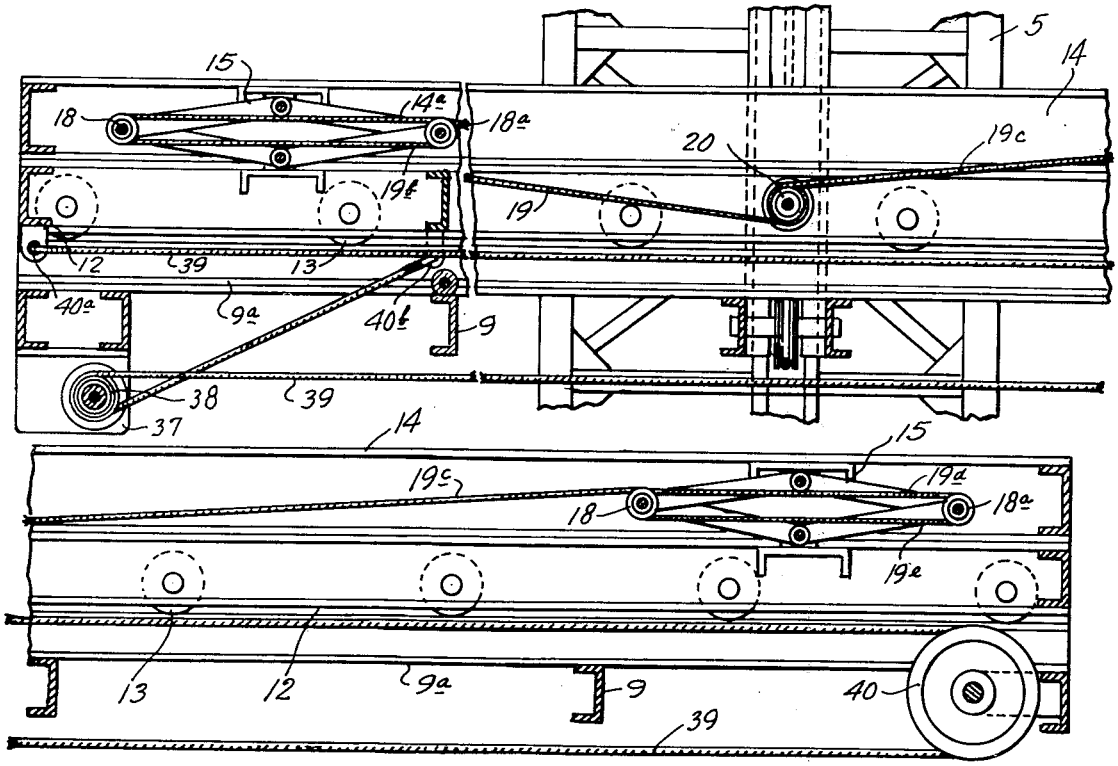

FIG. 4.
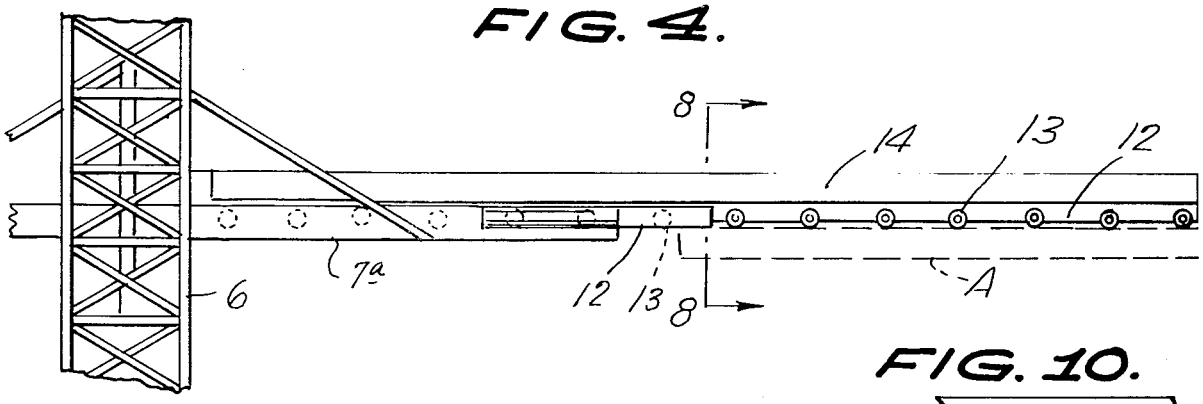
FIG. 10.
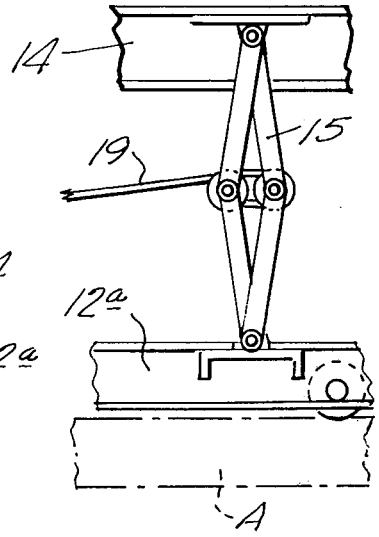
FIG. 8.
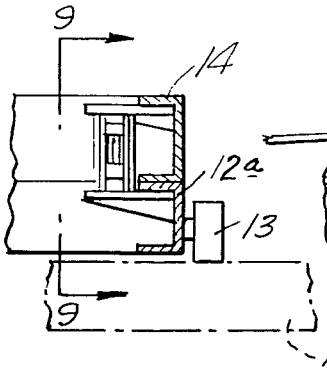
FIG. 9.
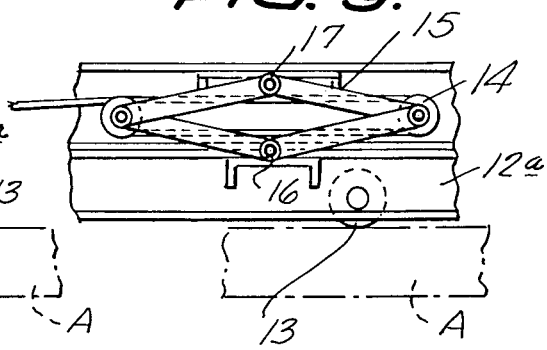
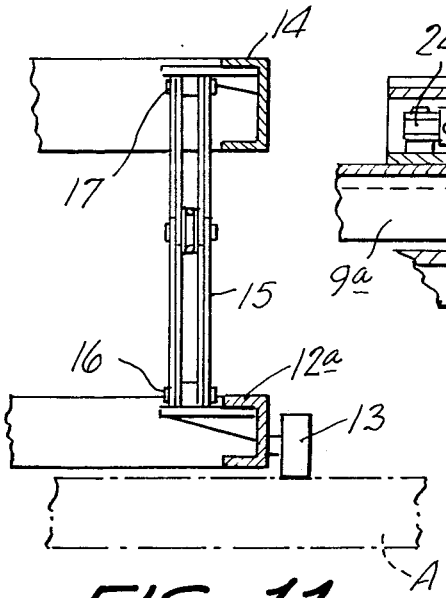
FIG. 11.
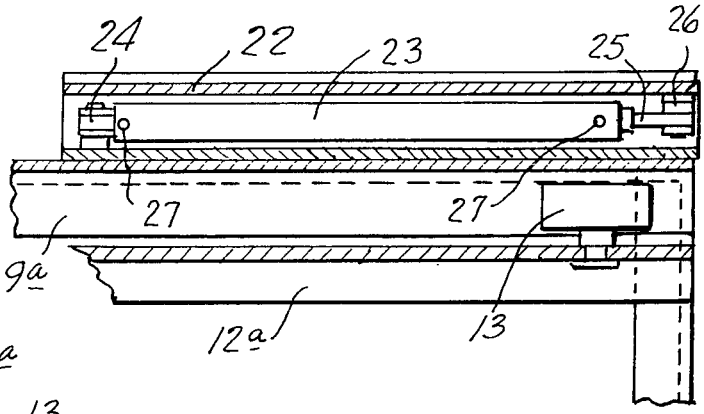
FIG. 12.

MOBIL LOAD RAISING STRUCTURE

The present invention is concerned with a mobile structure for raising loads vertically and then laterally of the structure or to the structure and then raising or lowering said loads.

The principal object of the present invention is to provide a structure moveable over the ground or on tracks alongside of a building under construction and which structure can raise loads to the various floors of said building and dispose the loads at any desired level or remove loads from any floor of the building and lower or raise the load to other floors or to the ground.

Further objects of the invention will be in part pointed out and in part obvious from the following detailed description of the accompanying drawings, in which, FIG. 1 is a top view of the present structure, FIG. 2 is a side view of the structure with the load carrier thereof partly raised, FIG. 3 is a view from the right side of FIG. 2, FIG. 4 is an end view of a portion of the load carrier partially extended.

Figure 1:
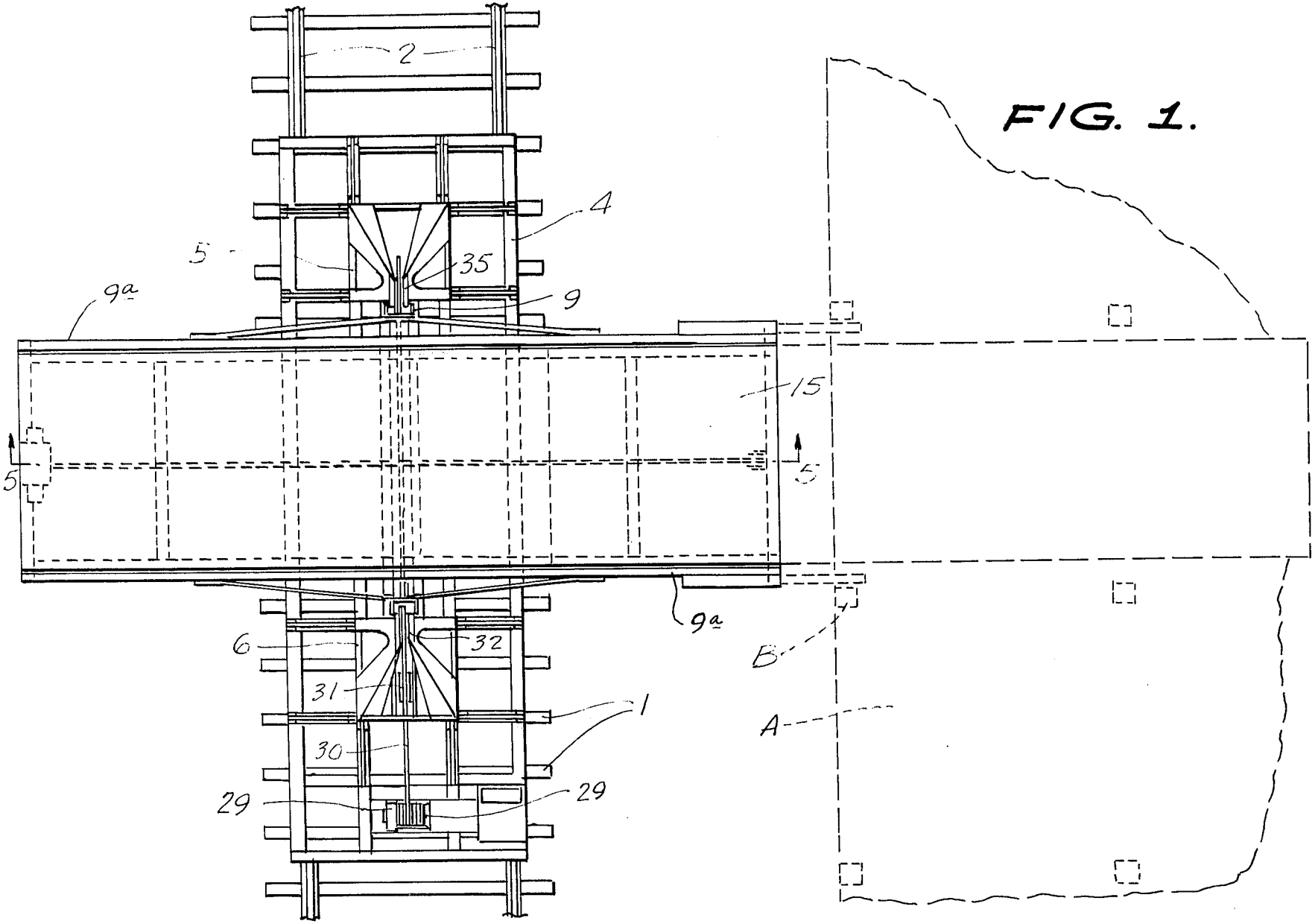

FIG. 8 is a cross-sectional view of a right hand side portion of the load carrier, FIG. 9 is a right hand side view of FIG. 8, FIG. 10 is a view similar to FIG. 9, but with one of the load carrier raising mechanisms in its extended position, FIG. 11 is a cross-sectional view taken on line 11—11 of FIG. 10, and, FIG. 12 is a view similar to FIG. 10, but with the one frame of the load carrier fully extended.

Referring now more particularly to the drawings in which like and corresponding elements are designated by similar reference characters, numeral 1 indicates track ties laid upon the ground and supporting tracks 2 extending alongside, but spaced from a building under construction having concrete floors A and columns B.

A platform 4 has rotatably wheels 3 running on tracks 2 so that said platform can be moved along said tracks. It is to be appreciated that driven endless tracks (not shown) can equally as well be used to support platform 4 instead of wheels 3, tracks 2 and ties 1.

A pair of towers 5 and 6 are fixedly and vertically supported on platform 4, in a spaced apart relationship. Tracks 7 and 8 each of a T-shaped cross-section, are attached to towers 5 and 6, respectively, and extend longitudinally of the opposing faces of said towers.

Figure 6:
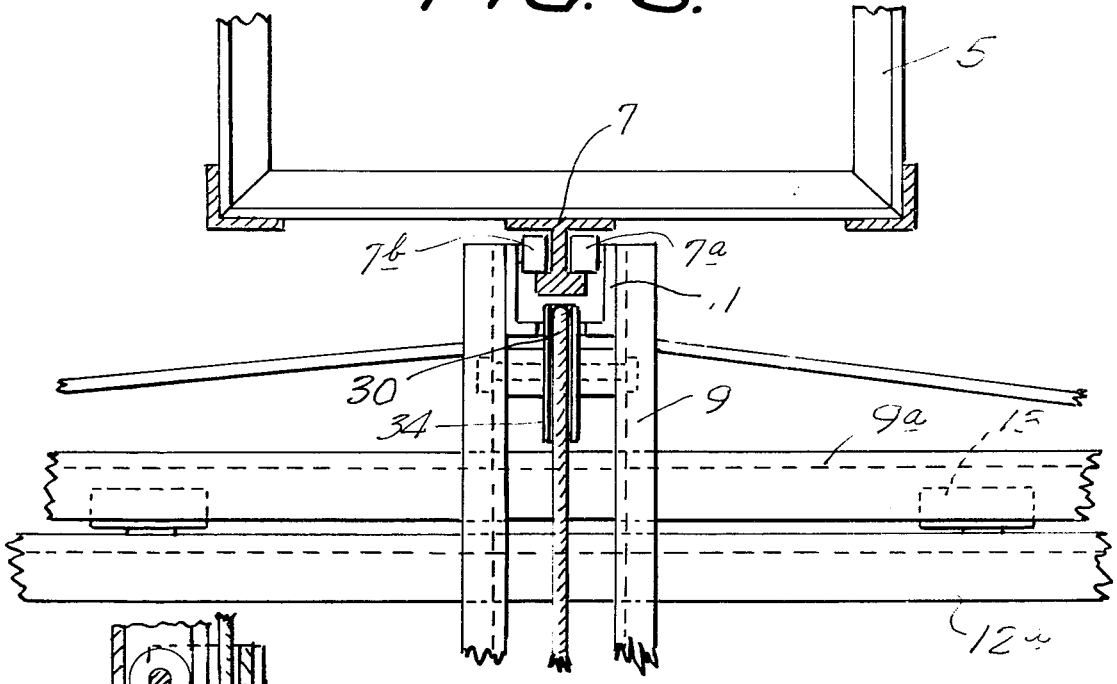
FIG. 6 is an enlarged sectional view taken on line 6—6 of FIG. 2.

A frame 9 has uprights 10 and 11 each of U-shaped crosssectional configuration, at the opposite ends thereof with a pair of rollers 7*a* and 7*b* in each of said uprights riding on tracks 7 and 8. As both upright roller arrangements are the same, one is shown in detail in FIG. 6.

Figure 7:
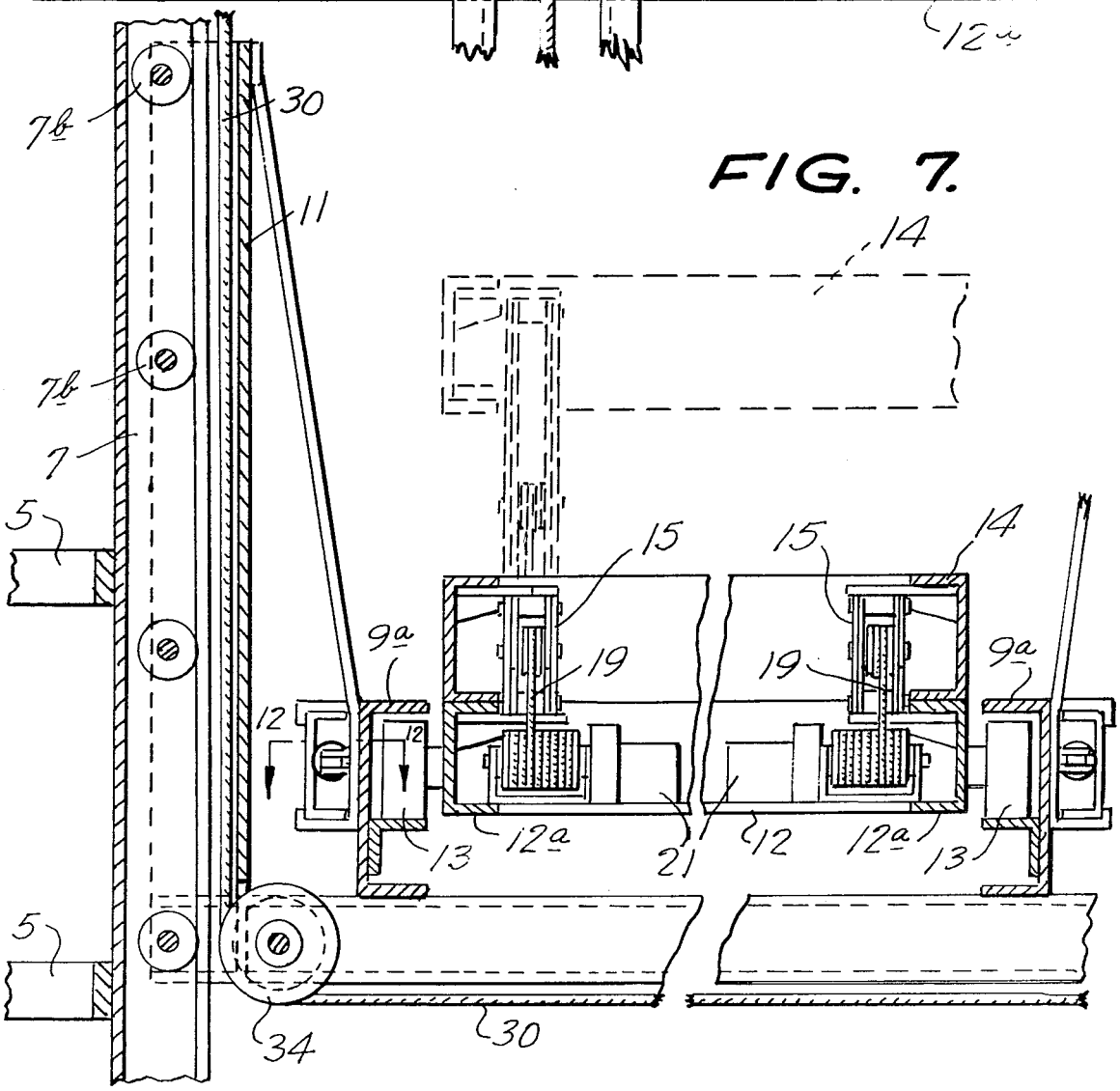
FIG. 7 is a cross-sectional view taken on line 7—7 of FIG. 5.

A pair of parrallel spaced apart C-shaped beams 9*a* are fixedly mounted on and extend laterally of frame 9. A load carrier frame 12 has rollers 13 carried by the opposite longitudinal sides 12*a* thereof with rollers 13 inside each beam 9*a* as indicated in FIG. 7.

Said frame 12 has a second load carrier frame 14 positioned thereon.

Two pairs of scissor jacks 15 are pivotally mounted as at 16 in FIG. 9 to frame sides 12*a* and at 17 to frame 14. Each scissor jack 15 has rollers 18 and 18*a* at their medial pivots.

Figure 5:
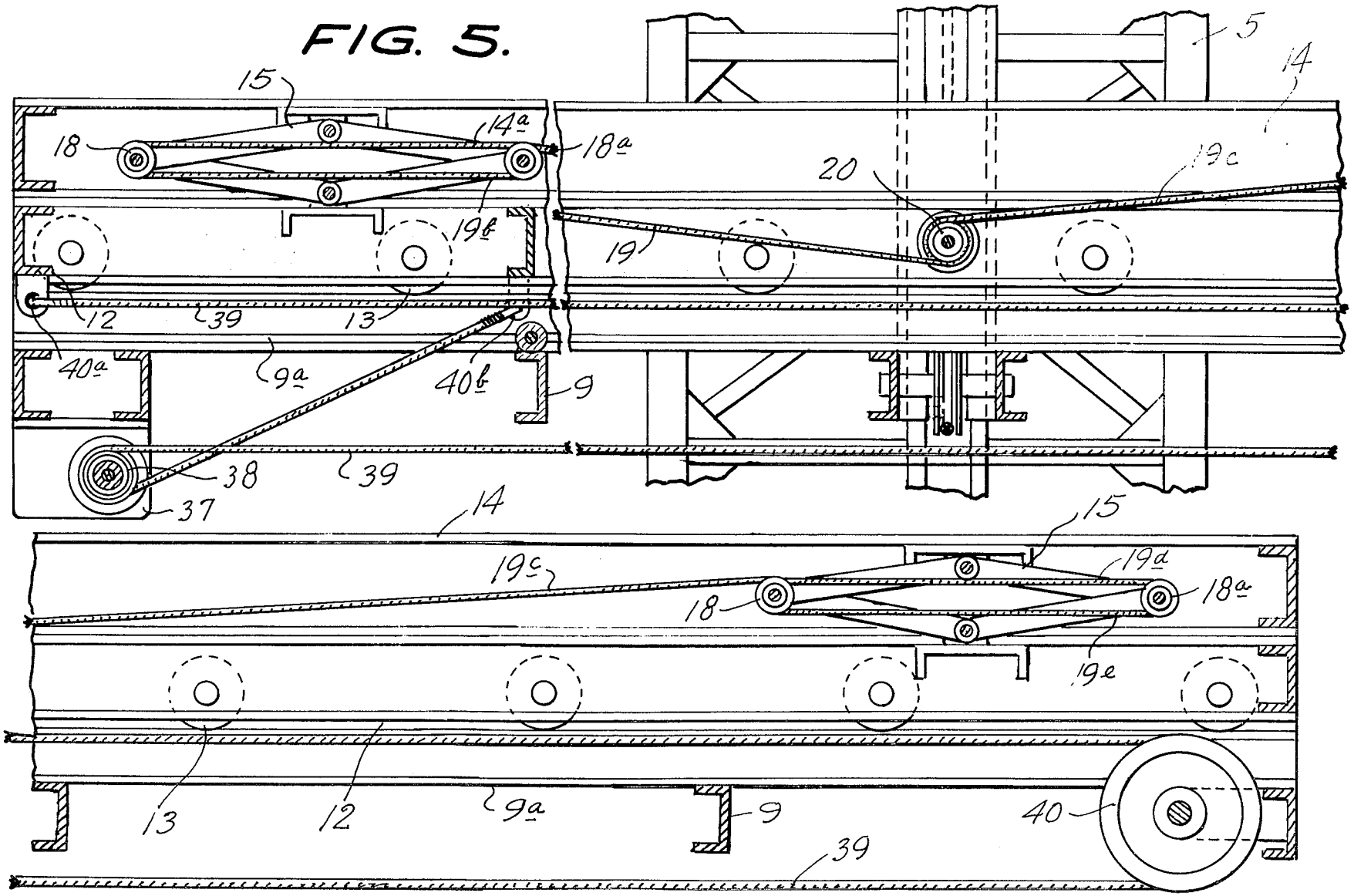
FIG. 5 is an enlarged sectional view taken on line 5—5 of FIG. 1.

A pair of cables 19 each, as shown in FIG. 5, have a portion 19*a* extending over rollers 18*a* and 18 of one jack 15, portion 19*b* attached to roller 18*a*, portion 19*c* extending over rollers 18 and 18 *a* of the second jack on the same side of frame 14 while the cable 19 between portions 19*a* and 19*c* is wrapped around a roller 20 rotatably mounted on frame 12. Each roller 20 is driven by an electric motor 21.

Figure 3:
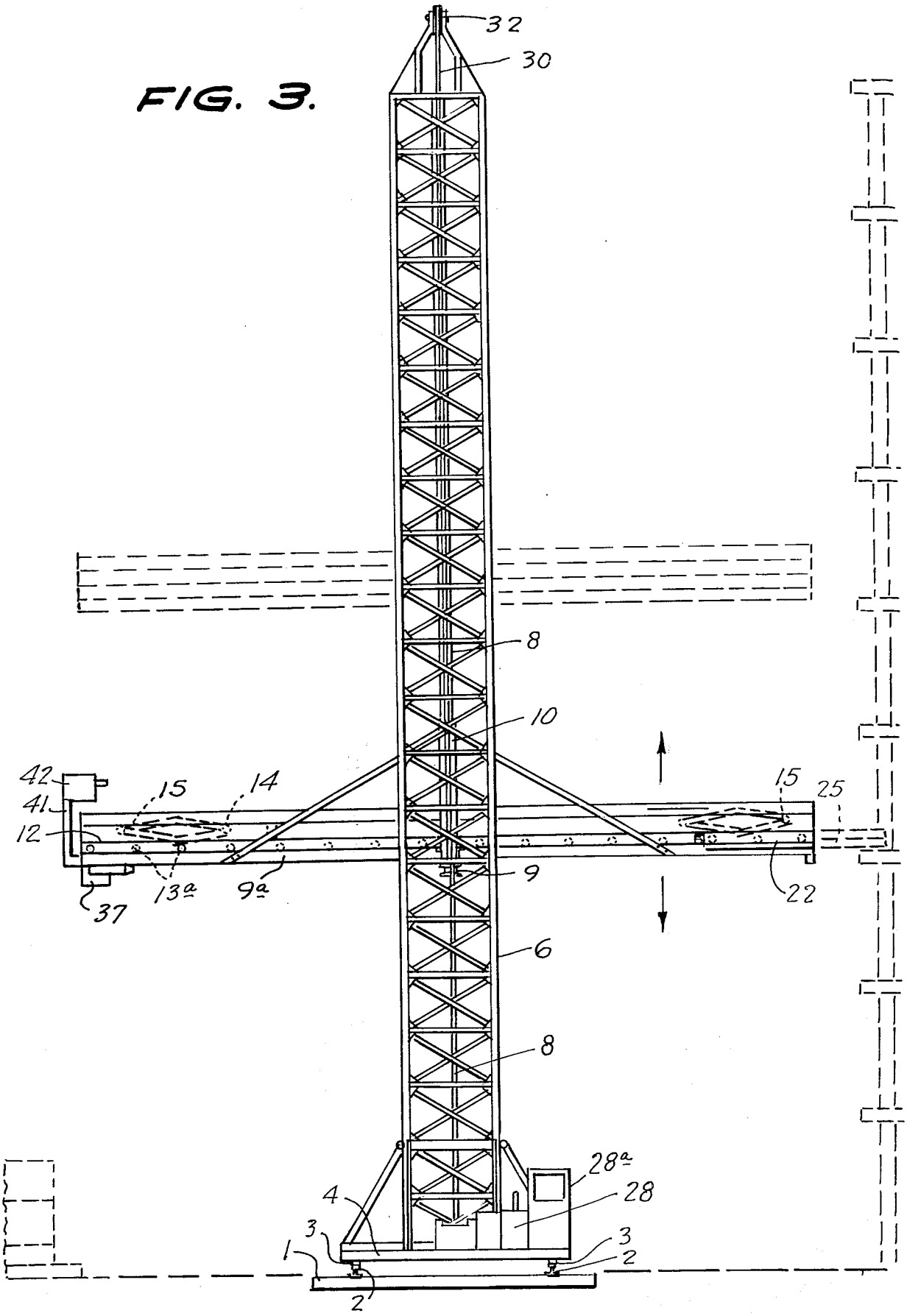

On the right hand end of frame sides 9*a*, as viewed in FIG. 3, there are a pair of tubes 22 fixedly attached to the exterior of said frame sides, see FIG. 12 with hydraulic cylinders 23 pivotably connected at 24 in each tube 22 and having a piston rod 25 slideably extending through tube guides 26. Hoses (not shown) for supplying fluid under pressure to openings 27 on said cylinders 23 extend to a source of said fluid (also not shown).

Engine 28 is operatively connected to drum 29 around which is wound cable 30. Said cable extends over pulleys 31, 32, 33, 34 and 35 and is attached at 36 to platform 4.

An electric motor 37 is connected to the bottom of frame 9 and is operatively connected to drum 38 around which cable 39 is wound. Said cable 39 extends around pulley 40 on one end of frame 9a and is attached at 40*a* and 40*b* to frame 12.

Figure 2:
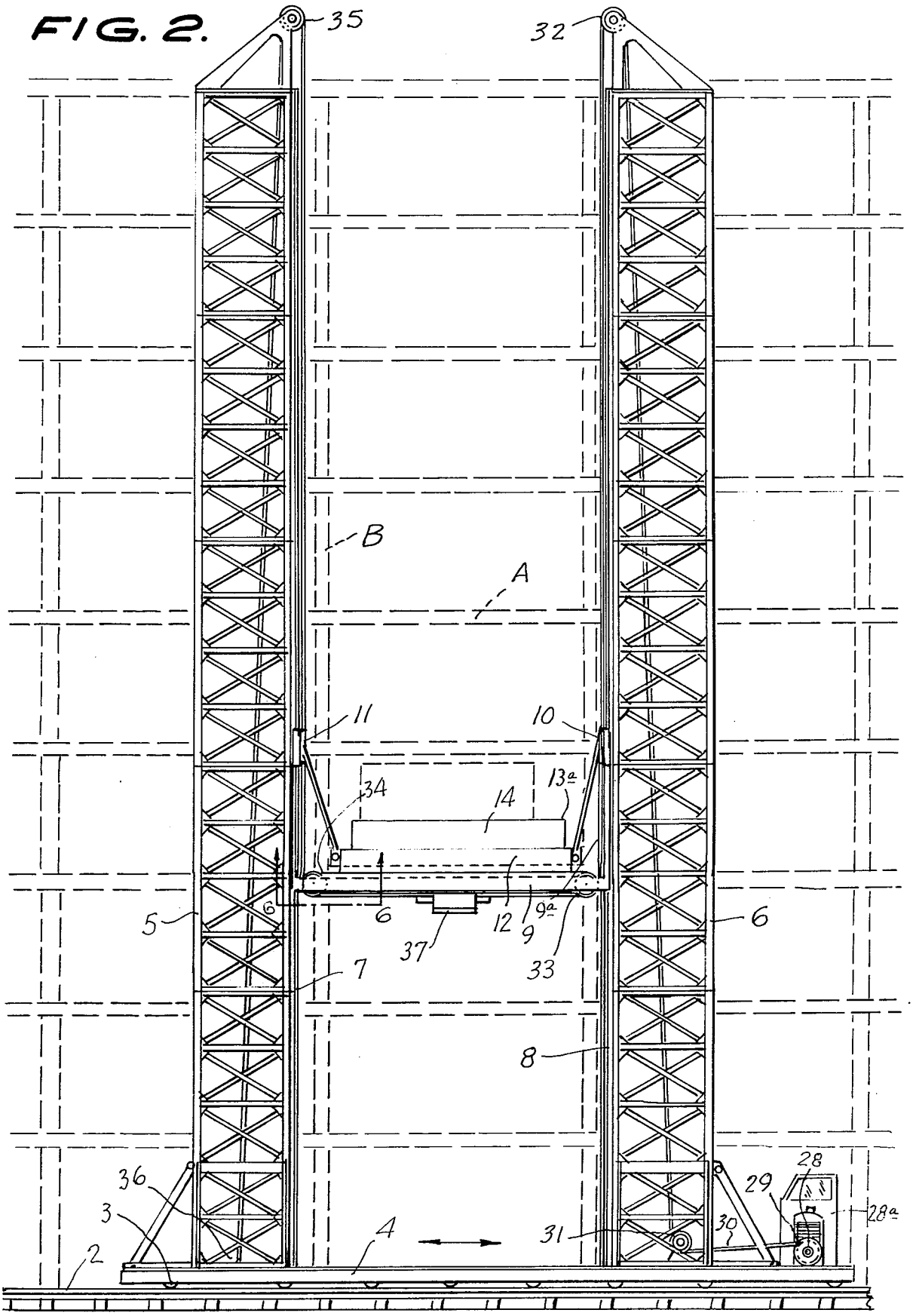

As indicated in FIG. 2, building frame A—B is shown by way of example only, as being ten stories high and towers 5 and 6 are shown as being eleven stories high. However towers 5 and 6 can be higher or shorter as desired.

Also frame 12 and 14 could each be twenty feet wide and one hundred feet long with frame 9 normally under the middle of frames 12 and 14 when said latter frames are in their closed position as shown in FIG. 3.

The above measurements are given only by way of an example as a preferred form to the structure, but can be greatly modified as desired.

A bracket 41 is connected to frame 12, see FIG. 3, and supports a closed circuit television projector 42 electrically connected to a television receiver (not shown) in cab 28*a* whereby an operator can view the movement of frames 12 and 14 for guiding the direction and extension thereof.

In the use of the present structure, tracks 2 are laid on the ground parallel to a side of a building frame A—B at a position so that frames 12 and 14 have their ends adjacent said building frame spaced from said housing frame about 50 feet, for example. Platform 4 is then moved along said tracks by a conventional means, such as a tractor (not shown), for example, to a position where frames 12 and 14 can be extended between a pair of columns B such as indicated dotted lines in FIGS. 1 and 2. Thereupon material, such as building material including stacks of long boards or panels, can be placed on frame 14 and an operator manipulating controls in cab 28*a*, can operate engine 28 to rotate drum 29 drawing cable 30 on said drum and thereby raising frames 9, 9*a*, 12 and 14 upwardly of towers 5 and 6 until rollers 13 are aligned with the top surface of anyone of the building floors A as desired. Thereupon piston rods 25 are extended over floor A.

The operator in cab 28*a* viewing frames 12 and 14 and the building in front of the same through the television, can determine the proper relative position of said frames to said building. When the frames and building are properly aligned, the operator can operate further controls in cab 28*a* connected to motor 27 for operating the same, drawing cable 39 on drum 38 causing frames 12 and 14 to move over the floor A in front thereof so that rollers 13 move onto floor A supporting the frames and loaded material thereon. When desired motors 21 can be operated to raise frame 14 so that material thereon can be loaded or unloaded from any height between floors A as desired.

It is obvious that frames 9, 9*a*, 12 and 14 can be raised or lowered when supporting material or not, from floor to floor as desired.

I claim:

1. A mobile load raising structure comprising a mobile platform, towers mounted on said platform in spaced apart relationship and extending upright with said platform, a load supporting member extending between and beyond said towers and slideably mounted on said towers for movement longitudinally thereof, means for raising and lowering said load supporting member upwardly and downwardly of said towers, said load supporting member comprising a frame extending laterally between said towers, C-shaped beams being mounted on and extending laterally of said frame, a load carrier frame extending laterally of said first frame, rollers rotatably mounted on said load carrier frame and riding in said C-shaped beams, a second load carrier frame detachably positioned on said first load carrier frame, a plurality of scissor jacks pivotally connected to said first and second load carrier frames and means for operating said scissor jacks for raising and lowering said second load carrier frame relative to said first load carrier frame, and means for moving said first load carrier longitudinally of said C-shaped beams, further wherein said means for operating said scissor jacks includes rollers rotatably mounted on the medial pivots of said jacks, at least one cable extending over said rollers and having its ends attached to one of the rollers of each of said scissor jacks and a driven roller mounted on said first load carrier frame and having said cable extending therearound.

2. A mobile load raising structure as claimed in claim 1 wherein said means for moving said first load carrier frame includes a driving motor with pulley mounted on one end portion of said first frame, a second pulley rotatably mounted on the other end portion of said first frame, and a cable having both ends connected to said first load carrier frame and extending around both said pulleys.

3. A mobile load raising structure as claimed in claim 1 including at least one tube fixedly mounted on an end portion of each of said C-shaped frames and extending longitudinally thereof, hydraulically driven cylinders each pivotally connected to and extending in one of said tubes and having a piston rod capable of extending from said tubes.

* * * * *